US005601447A

United States Patent [19]

Reed et al.

[11] Patent Number: 5,601,447

[45] Date of Patent: Feb. 11, 1997

[54] PATCH CORD ASSEMBLY

[76] Inventors: Carl G. Reed, 6780 Greenbrook Dr., Clemmons, N.C. 27012; Clifford F. Lincoln, 1433 Vernon Ridge Ct., Atlanta, Ga. 30338

[21] Appl. No.: 496,165

[22] Filed: Jun. 28, 1995

[51] Int. Cl.[6] ..... H01R 4/24

[52] U.S. Cl. ..... 439/404; 439/465; 439/941

[58] Field of Search ..... 439/404, 405, 439/460, 465, 466, 467, 456, 941

[56] References Cited

U.S. PATENT DOCUMENTS

| | | | |
|---|---|---|---|
| 4,163,598 | 8/1979 | Bianchi et al. | 439/467 |
| 4,408,823 | 10/1983 | Huber | 439/465 |
| 4,435,035 | 3/1984 | Berry et al. | 439/404 |
| 4,441,778 | 4/1984 | Sampson | 439/404 |
| 4,550,971 | 11/1985 | Gentric | 439/404 |
| 4,693,539 | 9/1987 | Tighe, Jr. | 439/465 |
| 4,887,977 | 12/1989 | Lemke | 439/465 |
| 4,968,260 | 11/1990 | Ingalsbe | 439/638 |
| 5,118,310 | 6/1992 | Stroede et al. | 439/405 |
| 5,226,835 | 7/1993 | Baker, III et al. | 439/403 |
| 5,308,258 | 5/1994 | Hatsios | 439/465 |

*Primary Examiner*—Gary E. Elkins

[57] ABSTRACT

This invention is directed to a patch cord cable assembly for use in a high speed transmission cable network, more particularly to an electrical connector which gives the assembly the capability of transmitting data at 100 MHz frequency while offering near-end crosstalk (NEXT) at EIA/TIA 568-A Category 5 performance levels. The preferred electrical connector comprises a pair of interfitting housing members, and a plurality of side-by-side electrical terminals positioned between the housing members for establishing electrical contact with the individual wires of a cable. The terminals are arranged at essentially one end of the housing members and the cable is caused to enter said housing members from an opposite end thereof. One of the housing members includes a cable jacket stop intermediate the ends and plural, spaced-apart posts between the cable jacket stop and the one end. The jacketed cable is fed into one housing member and the jacket about the cable seats in the cable jacket stop with selected pairs of twisted wire continuing toward the one end. Further, the respective pairs of wires are separated from adjacent pairs and spaced apart by the plural posts. Finally, the twists are maintained, and the respective ends of individual wires are positioned for termination to respective electrical terminals.

10 Claims, 8 Drawing Sheets

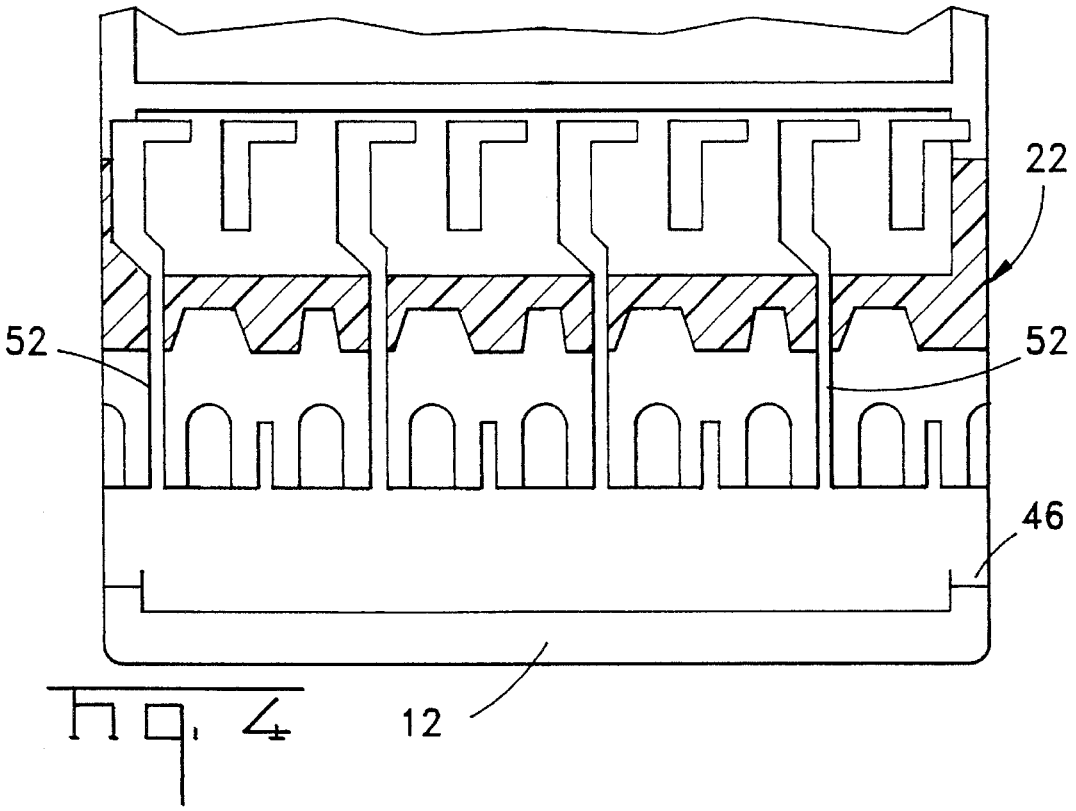
Fig. 4
Fig. 5
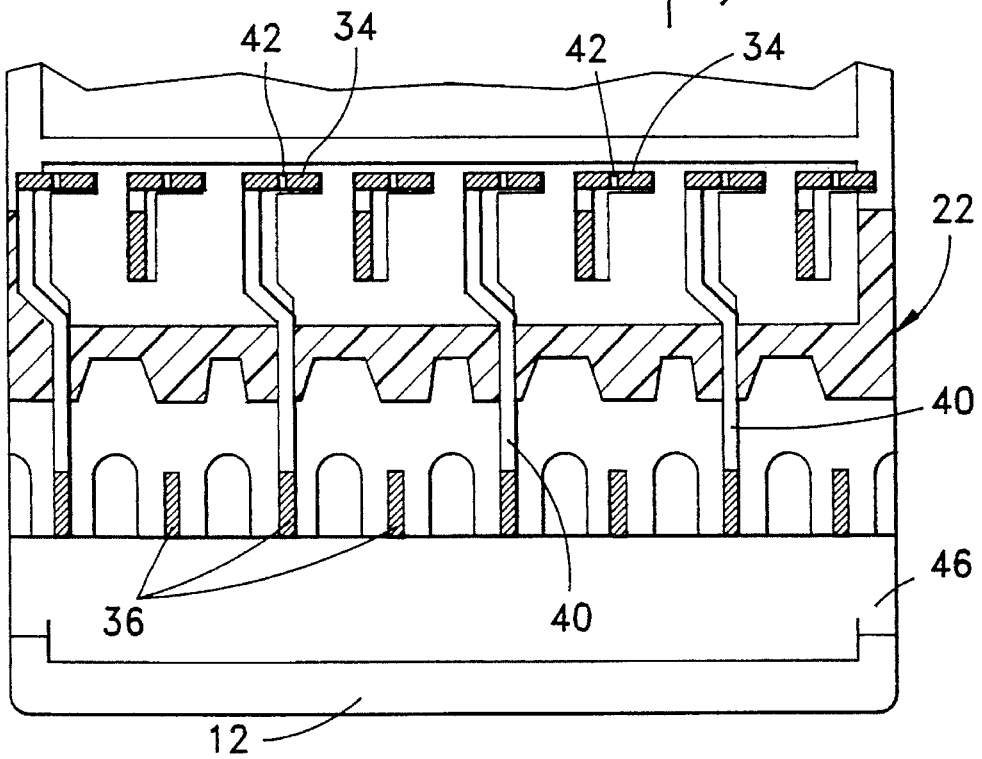

PATCH CORD ASSEMBLY

BACKGROUND OF THE INVENTION

This invention relates to a high performance patch cord assembly for the high frequency transmission of signals, particularly in the field of telecommunications. More specifically, the invention relates to an assembly that incorporates at least one electrical connector that features a plurality of flat blades as the connection interface for mating with a connecting block that includes a plurality of slotted beams, each pair of opposing beams to receive a respective flat blade.

High frequency transmission systems, particularly those offering Category 5 performance levels, are receiving increasing attention in the telecommunication area. However, to achieve such performance levels requires careful analysis of the total system, i.e. hardware and cabling. That is, the communication system and/or network efficiency is directly dependent upon the integrity of the connector scheme employed. Such connector schemes include, for example, standard interfaces for equipment/user access (outlet connector), transmission means (horizontal and backbone cabling), and administration/distribution points (cross-connect and patching facilities). Regardless of the type or capabilities of the transmission media used for an installation, the integrity of the wiring infrastructure is only as good as the performance of the individual components that bind it together and to the way in which these components are assembled.

Reliability, connection integrity and durability are also important considerations, since wiring life cycles typically span many years. In order to properly address specifications for, and performance of telecommunications connecting hardware, it is important to establish a meaningful and accessible point of reference. The primary reference, considered by many to be the international benchmark for commercially based telecommunications components and installations, is standard EIA/TIA-568-A (TIA-568-A) Commercial Building Telecommunications Wiring Standard. Among the many aspects of telecommunications wiring covered by these standards are connecting hardware design, reliability and transmission performance. Accordingly, the industry has established a common set of test methods and pass/fail criteria on which performance claims and comparative data may be based.

A primary performance criteria for connecting hardware is near-end crosstalk (NEXT), where connector crosstalk is a measure of signal coupling from one pair to another within a connector at various frequencies. Since crosstalk coupling is greatest between transmission segments close to the signal source, near end crosstalk (as opposed to far-end) is generally considered to be the worst case. Although measured values are negative, near-end crosstalk (NEXT) loss is expressed in decibels as a frequency dependent value. The higher the NEXT loss magnitude, the better the crosstalk performance. Near-end crosstalk loss, the more significant problem, may be defined as a measure of signal coupling from one circuit to another within a connector and is derived from swept frequency voltage measurements on short lengths of 100-ohm twisted-pair test leads terminated to the connector under test. A balanced input signal is applied to a disturbing pair of the connector while the induced signal on the disturbed pair is measured at the near-end of the test leads. In other words, NEXT loss is the way of describing the effects of signal coupling causing portions of the signal on one pair to appear on another pair as unwanted noise. In accordance with the standard set forth in EIA/TIA-568-A for Category 5 performance, at a frequency of 100 MHz, the performance must be at least −40 dB.

U.S. Pat. No. 5,226,835 represents a patch cord plug of the general type contemplated by this invention, where the reduced cross-talk of the patented device is achieved through the use of plural pairs of conductors that cross over and are spaced apart. The invention thereof is directed to a plug for interconnecting a pair of wires at its input with a pair of insulation displacement connectors (IDC) at its output. The plug comprises a dielectric housing and a pair of non-insulated conductors within the housing that cross over and are spaced apart from each other. Each conductor comprises a generally flat blade portion for insertion into an IDC at one end, and a terminal for making electrical contact with a wire at the other. A feature thereof is the provision that the conductors are identical to each other, but are reverse-mounted with respect to each other to achieve crossover. While such connector offers improved crosstalk performance, by the use of the conductor crossover scheme, a change is made in the termination sequence which can cause some wiring problems.

The present invention avoids the problems of the wiring sequence associated with the prior art while offering improved performance, particularly at Category 5 levels. The manner by which this performance level is achieved will become apparent in the description which follows, particularly when read in conjunction with the accompanying drawings.

SUMMARY OF THE INVENTION

This invention relates to a patch cord cable assembly for use in a high speed transmission cable network, where the assembly is capable of transmitting data at 100 MHz frequency while offering near-end crosstalk (NEXT) at EIA/TIA 568-A Category 5 performance levels. A typical patch cord assembly, as known in the art, consists of a pair of electrical connectors electrically connected to a length of plural conductors, typically twisted pairs of conductors within a dielectric jacket. This invention is directed particularly to one of the connectors which comprises a pair of interfitting housing members, and a plurality of side-by-side electrical terminals positioned between the housing members for establishing electrical contact with the individual wires in the cable. The terminals are arranged at essentially one end of the housing members and the cable is caused to enter the housing members from an opposite end thereof. One of the housing members includes a cable jacket stop intermediate the ends and plural, spaced-apart posts between the cable jacket stop and the one end. In the assembly of the connector, the jacketed cable is fed into the one housing member where the jacket end is seated and held in the cable jacket stop and each pair of twisted wires continue toward the one end, guided by said spaced-apart posts that aid in controlling the spacing, bend radius, and length of each pair. In this relationship, the respective ends of individual wires are positioned for and terminated to respective electrical terminals. There is no crossover of the terminals.

BRIEF DESCRIPTION OF DRAWINGS

FIG. 3 is a perspective view of the assembled connector of FIG. 2.

FIG. 4 is a sectional view, taken along line 4—4 of FIG. 2, of one of the interfitting members of this invention.

FIG. 5 is a sectional view, taken along line 5—5 of FIG. 3, showing the terminal loaded connector of this invention.

DETAILED DESCRIPTION OF PREFERRED EMBODIMENT

Figure 1:
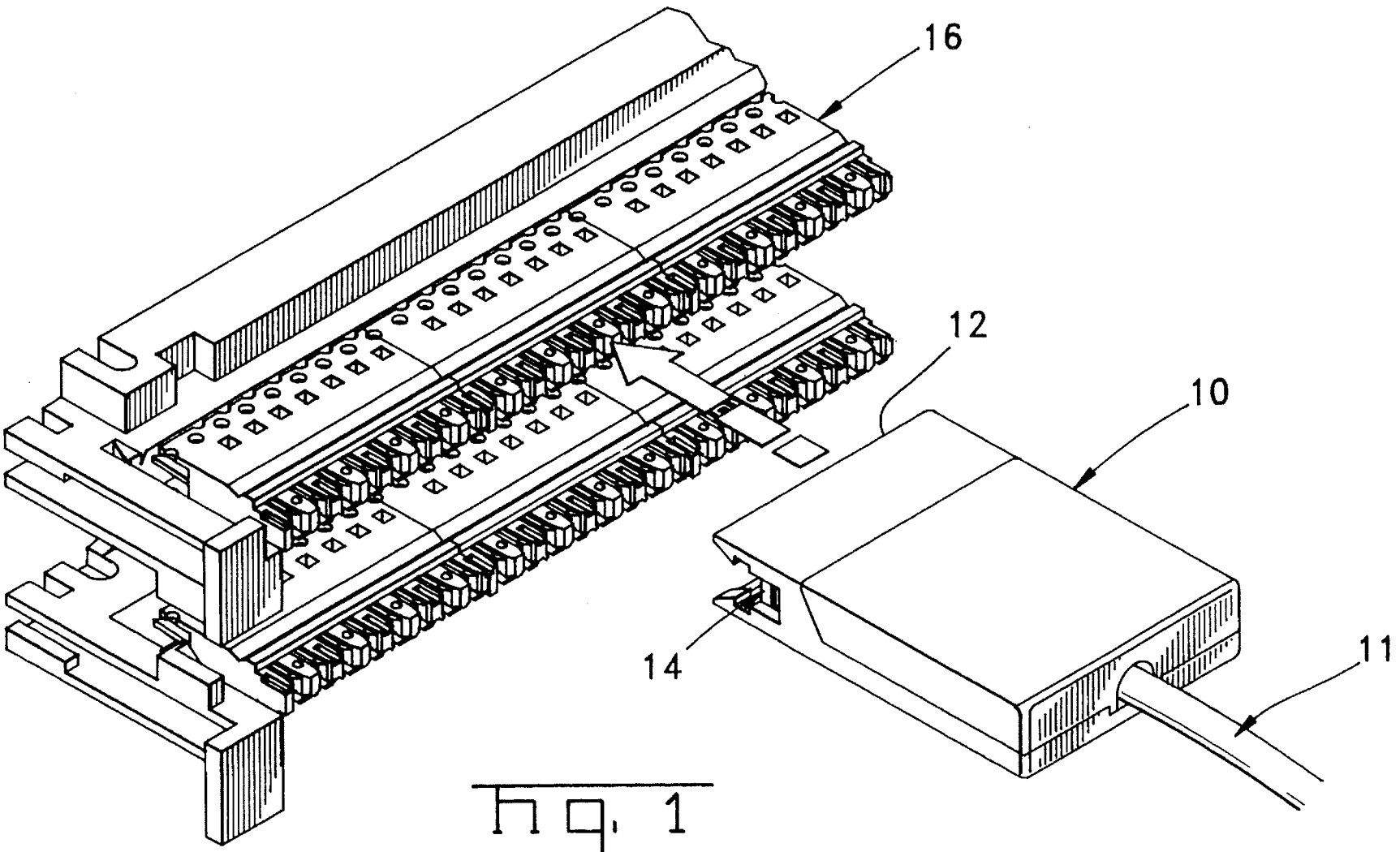
FIG. 1 is a perspective view of one end of a patch cord cable assembly utilizing an electrical connector in accordance with the teachings of this invention, where such connector is shown poised for termination to a connector wiring block, also known in the art as a 110 cross connect block.

This invention relates to a high performance patch cord cable assembly, where a partial patch cord assembly according to this invention is illustrated in FIG. 1. A typical patch cord assembly comprises a pair of electrical connectors 10 electrically terminated to the respective ends of a discrete length of cable 11, where the cable consists of a plurality of pairs of twisted, insulation covered wires 13 contained within an insulation jacket, see FIG. 6, for example. At the remote ends of the respective connectors, means are provided for mating with a complementary connector. In the preferred embodiment of this invention, where the details of the electrical connector 10 are shown in FIGS. 2 to 9, the remote or mating end 12 of such connector includes plural terminals 14, each having a vertically oriented blade portion for mating with a connecting block 16, as known in the art, where such connecting block includes a plurality of split beam contacts which receive and electrically engage the blade portions of electrical terminals 14.

Figure 2A:
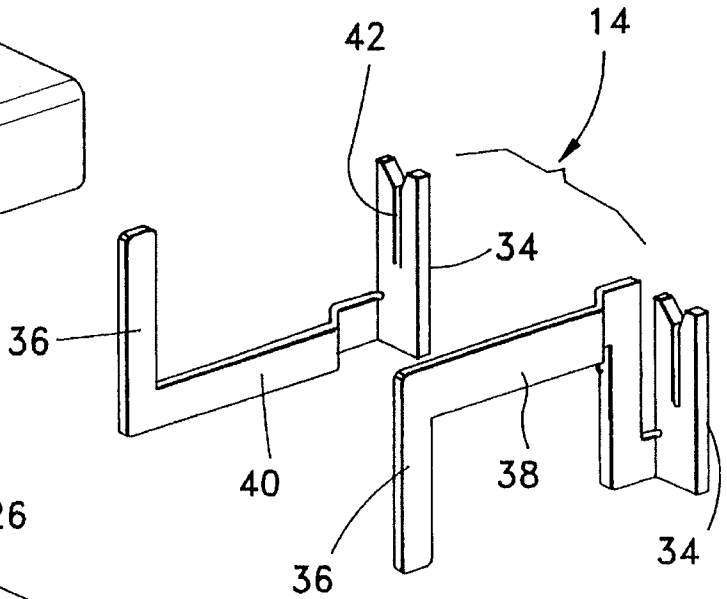
FIG. 2A is an enlarged perspective view of a pair of adjacent electrical terminals for use in the patch cord cable assembly of this invention.
Figure 2:
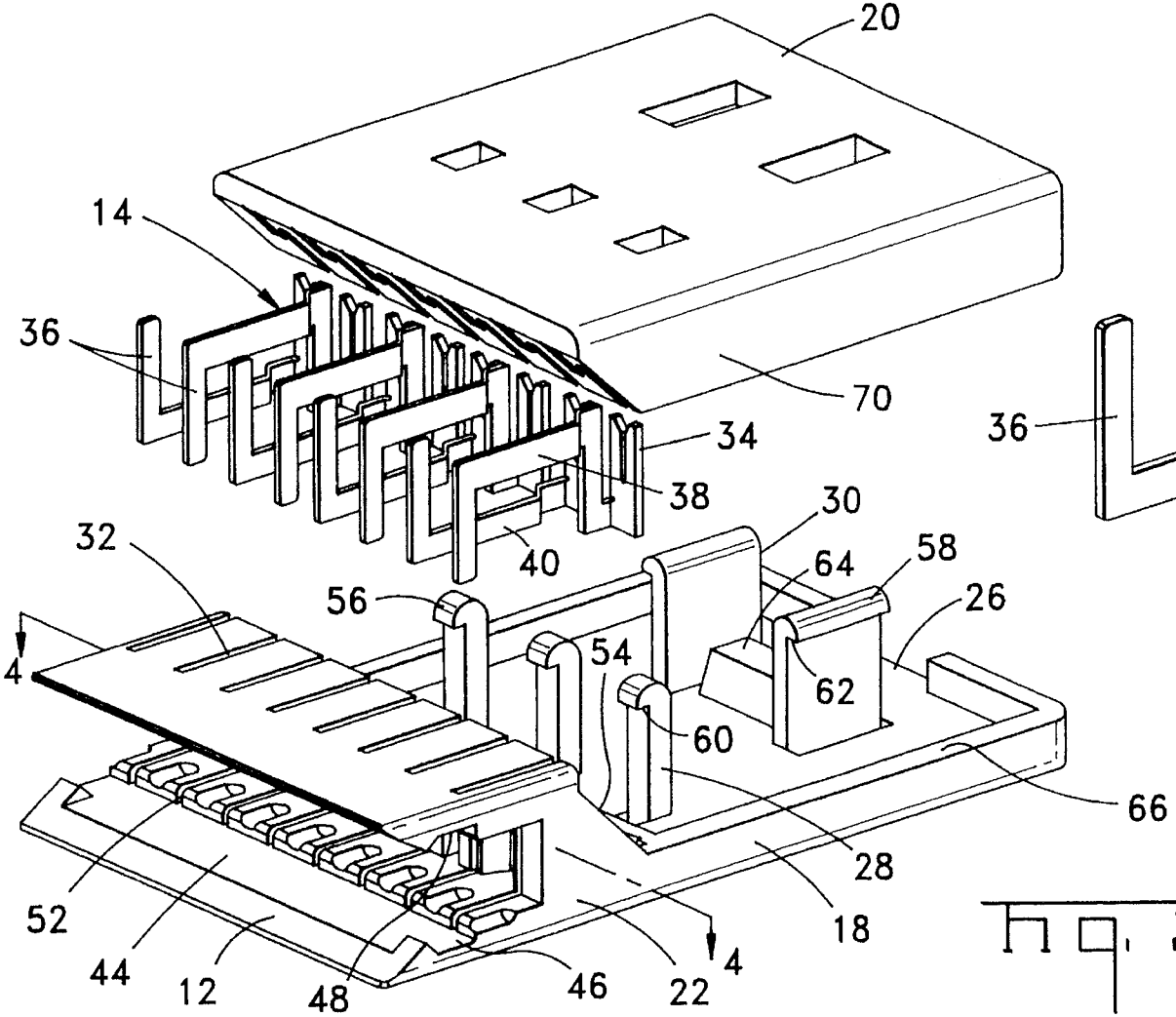
FIG. 2 is an exploded perspective view of a preferred electrical connector forming one connector of a patch cord cable assembly.

FIG. 2, in an exploded fashion, illustrates the preferred electrical connector 10 of this invention, where such connector forms a part of the assembly hereof. The connector 10 comprises a first housing member 18, a second housing member 20 matable with said first housing member 18, and a plurality of electrical terminals 14. Considering the first of such housing members, first housing member 18 comprises a dielectric body 22 having a mating end 12, a cable receiving end 26, plural latching arms 28, 30, and a plurality of vertically oriented slots 32, where each said slot is dimensioned and positioned to receive a single electrical terminal 14.

Before describing the mating end 12 in further detail, it may be helpful to shift attention to the design of the electrical terminals 14 arranged in side-by-side fashion within the connector. Such terminals 14, preferably stamped and formed from a sheet metal blank, have an insulation displacement feature at end 34 angled transversely of the connector housing to receive one of the individual wires 13 of the cable 11. The opposite end of the terminal includes a vertically oriented blade portion 36, which as noted above is intended to mate with a connecting block, sometimes referred to in the prior art as a 110 cross connect block. Intermediate the respective ends the terminals are different, however, alternate terminals are essentially identical. By way of example, in an 8 position connector, terminals 1, 3, 5, 7 are the same, while terminals 2, 4, 6, 8 are the same. In any case, a first set of such terminals includes a shank portion 38 that is "Z" shaped, connected to the base of insulation displacement end 34 and the top of blade portion 36. The other set of terminals includes a shank portion 40 which is connected to the respective bases of the end 34 and blade portion 36, where FIG. 2A illustrates a pair of terminals, one from each set. By this arrangement, sections of adjacent shank portions 38, 40 are vertically displaced from one another, thereby helping to promote the improved crosstalk performance of the connector 10. As shown in FIG. 2A, the respective shank portions 38, 40 are aligned with their respective termination slots 42 of the termination end 34.

Returning now to the design and construction of the first housing member 18, the mating end 12 features a recessed opening 44 defined by a lower wall 46 and an upper wall 48. The upper wall 48 includes a plurality of through slots 32, one slot for each terminal 14, while the lower wall 46 includes a like plurality of aligned grooves 52 into which such terminals seat. Rearward and internally of the mating end 12 is an angled wall 54 against which a complementary end of the second housing member seats.

Interiorally of the first housing member 18 are the plural latching arms 28, 30. Such arms are preferably arranged in groups, with a first group of arms 28 laterally arranged near the angled wall 54, and the second group of arms 30 positioned near the cable receiving end 26. Each such arm includes a latching or remote end 56, 58 having a shoulder 60, 62 for engaging a complementary recess in the second housing member 20, as hereinafter explained. Finally, between the arms 30, an upstanding projection 64 is provided. The projection 64, as will be apparent in the assembly of the connector housing members, functions as a strain relief to the overlying cable 11.

Figure 6:
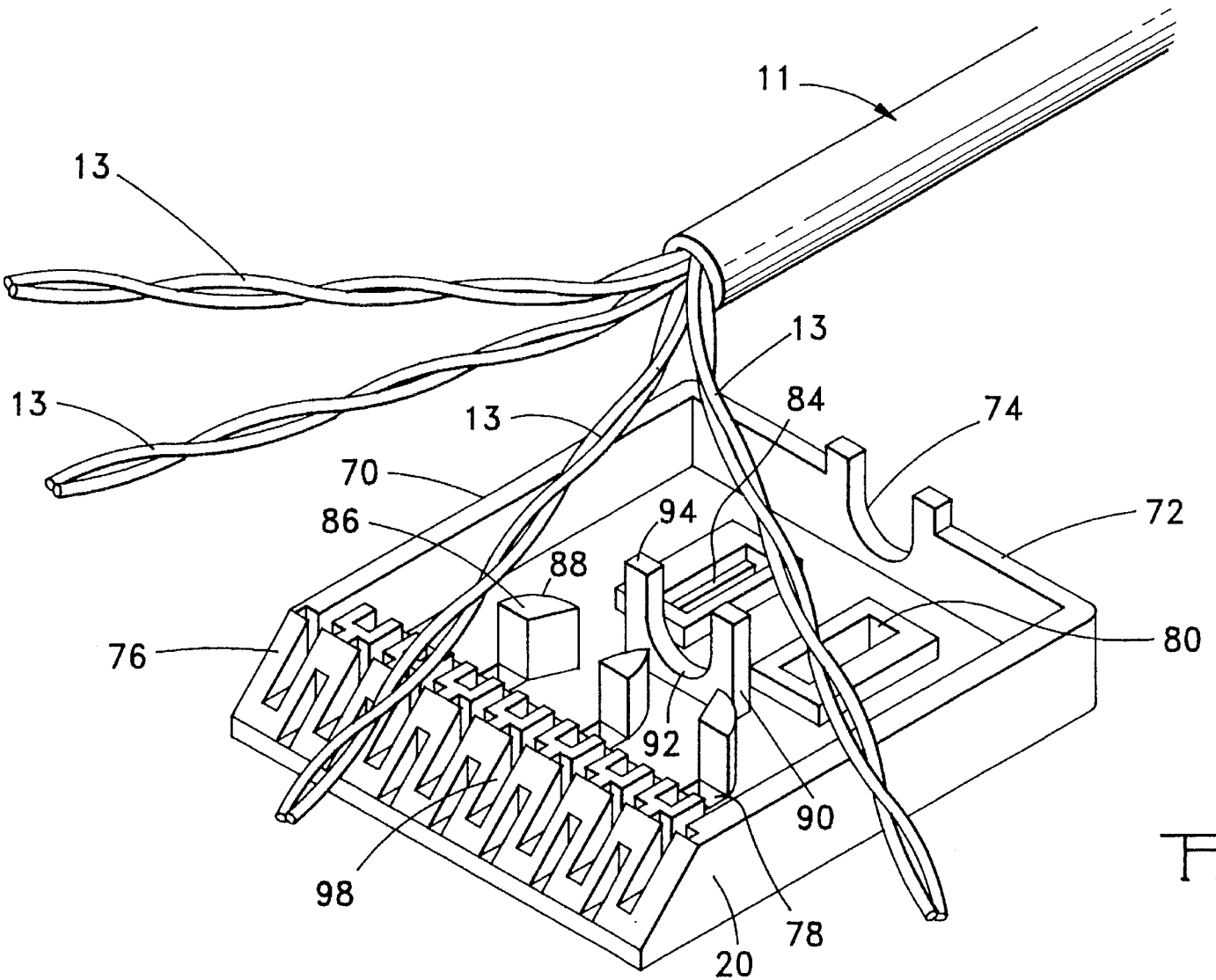
FIG. 6 is a perspective view of one of the interfitting housing members of this invention, where such one housing member initially receives a twisted pair cable having up to four pairs of wire.
Figure 7:
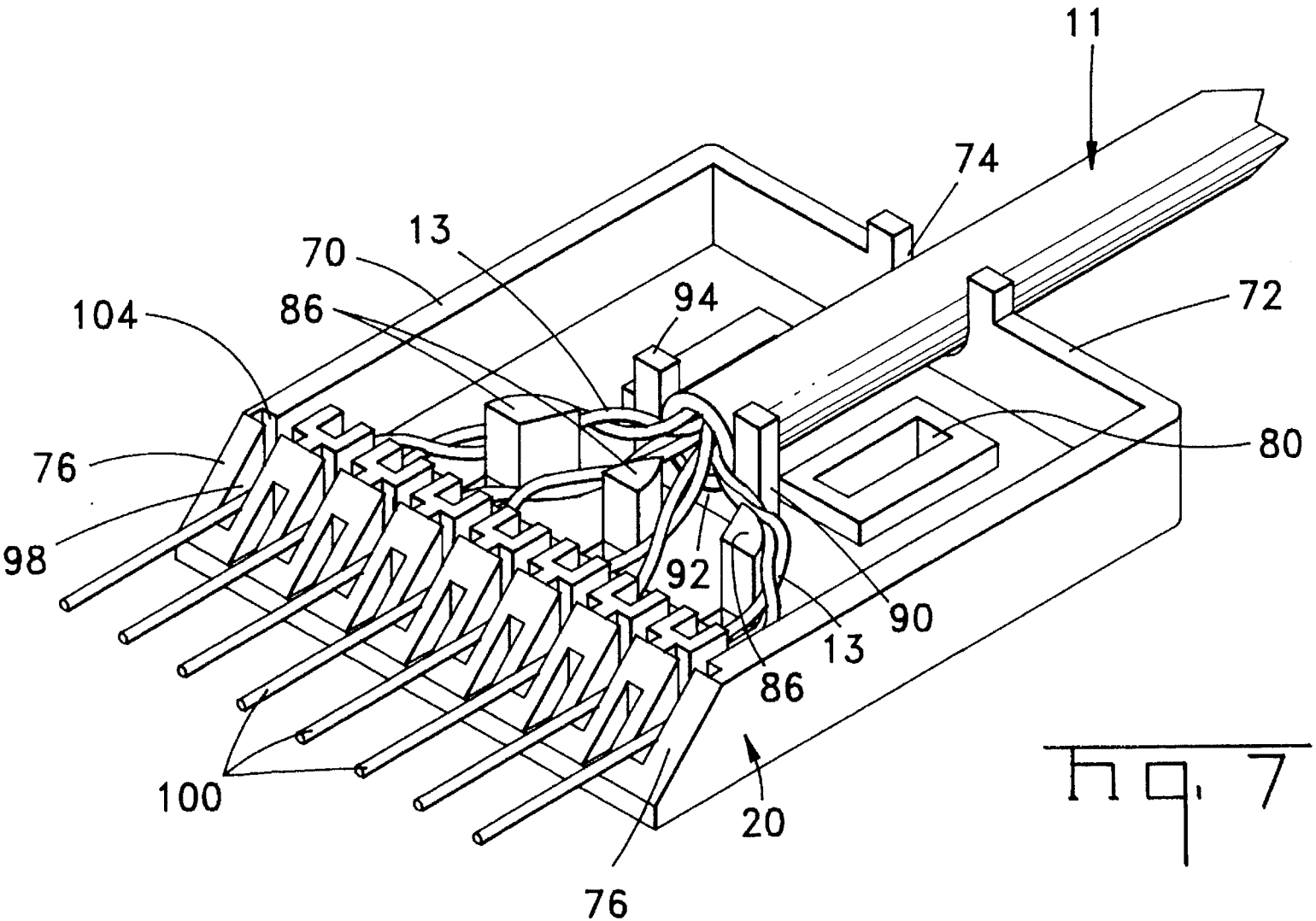

The second housing member 20, as best seen in FIGS. 2, 3 and 6, is essentially rectangular in shape and designed to seat on the peripheral shoulder 66 of the first housing member 18, and against the angled wall 54 thereof. The second housing member 20 includes a pair of side walls 70, a rear wall 72 having a slot 74 therein to override the cable 11, and a forward angled face 76, which as noted above lies contiguous with the angled wall 54 of first housing member 18 in the mated condition. Interiorly, the second housing member 20 includes plural openings 78, 80, corresponding to the shape and position of the latching arms 28, 30, where each such opening includes a recessed shoulder 82, 84 (FIGS. 6 & 9) to receive in latching engagement the remote ends 56, 58, respectively. Additionally, adjacent the openings 78, plural, upstanding posts 86 are provided, where such posts include at least one curved wall 88 against which a selected pair of wires lie at the assembly stage of the connector. This latter feature will become apparent in the description of FIG. 7. Finally, intermediate the respective openings 78, 80, the second housing member 20 is provided with a centrally positioned cable jacket stop 90, where such stop is configured with a rounded base 92 between upstanding posts 94. Again, the manner by which the stop is utilized herein will become clearer in the description of FIGS. 7 and 8.

Figure 7:
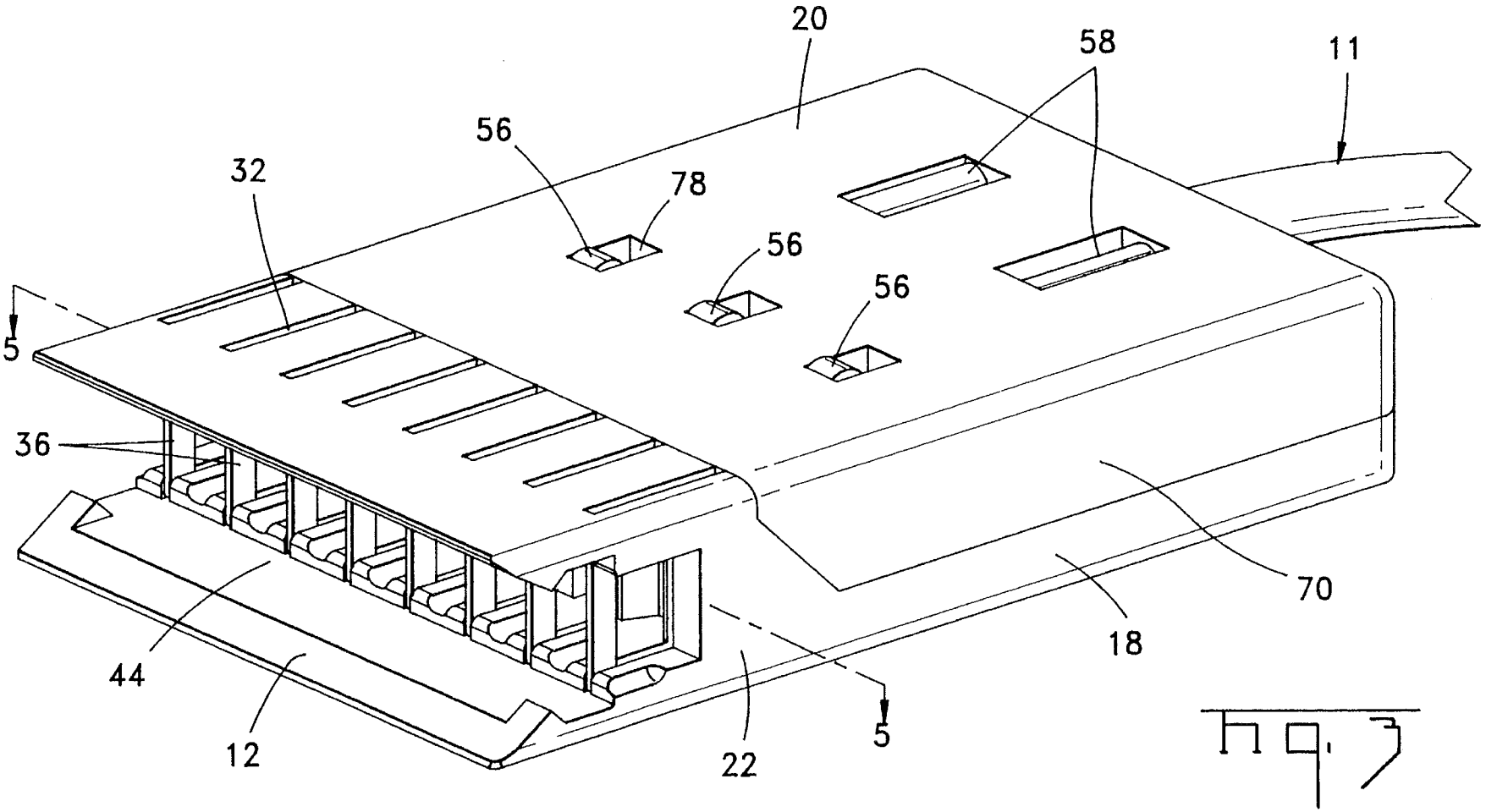
FIG. 7 is a perspective view similar to FIG. 6, showing the twisted pair cable nesting within such one housing member prior to termination and mating of the pair of housing/members forming the connector hereof.
Figure 8:
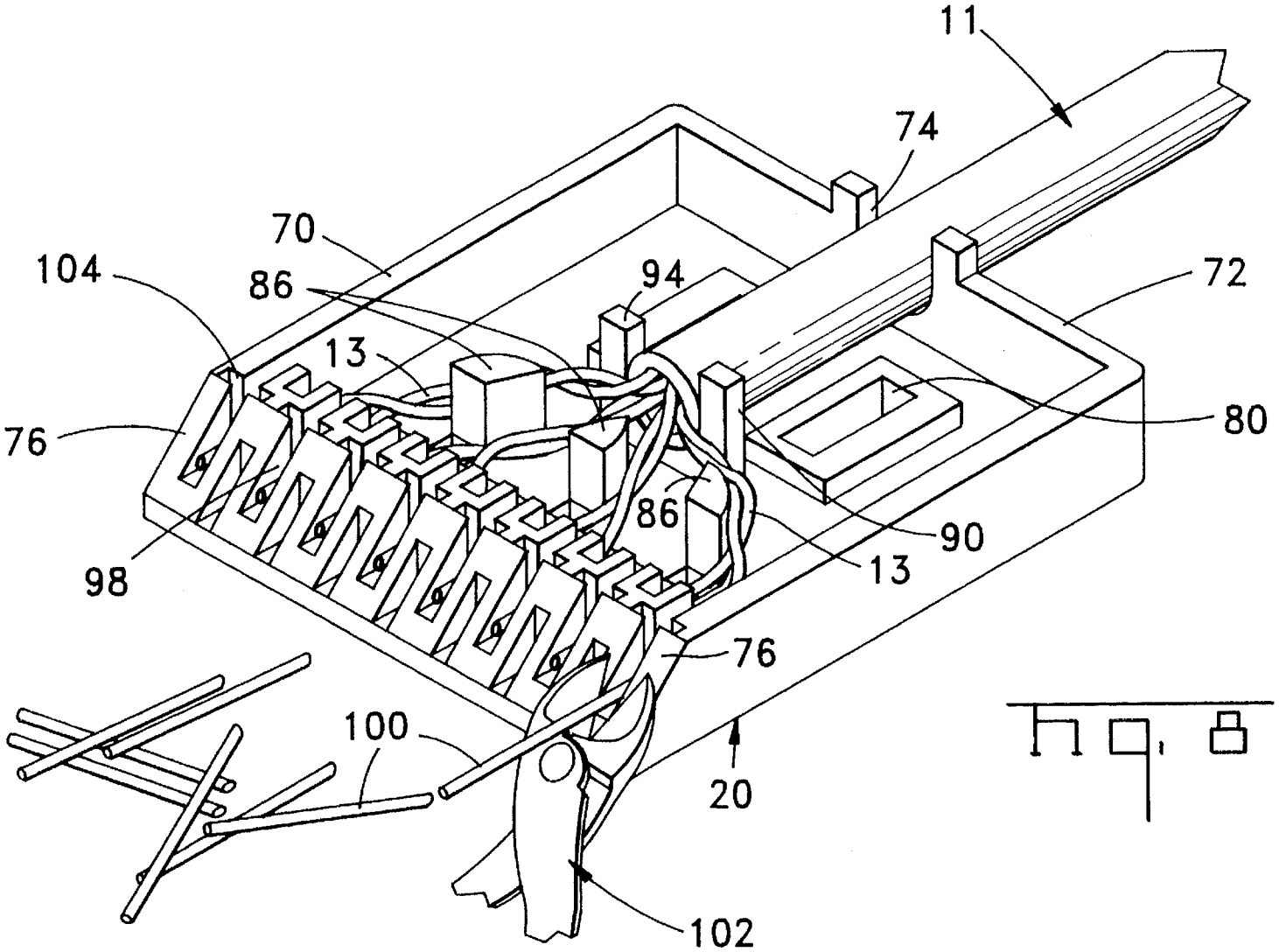
FIG. 8 is a perspective view similar to FIG. 7 showing the manner by which the wire ends are cut along the angled face of said one housing member.

The assembly of the connector 10 is best illustrated by the sequence of FIGS. 6 to 8. Initially, the cable 11 is prepared by removing the jacket or outer wrap from the cable end to expose the plural pairs of twisted wires, four pairs being illustrated in this particular embodiment. Since the individual wires are insulation covered and color-coded, it is a relatively simple matter to position the wires for termination. In any case, with the selected pairs maintained in a twisted state, the cable 11 is positioned within the second housing member 20 (see FIG. 7), with the cable jacket seated on and ending just past the cable jacket stop 90. Each twisted pair of wires is then firmly pulled around the plural posts 86, and then positioned in the appropriate slots 98 for IDC termination, as known in the art. This procedure maintains a prescribed or minimum length of each twisted pair from cable jacket end to IDC slot. However, before such termination, the wire ends 100 are trimmed, such as known by a suitable flush cutting tool 102 (FIG. 8) along the angled face 76 to ensure that the remaining wire ends are short of the front edge of housing member 20.

Figure 9:
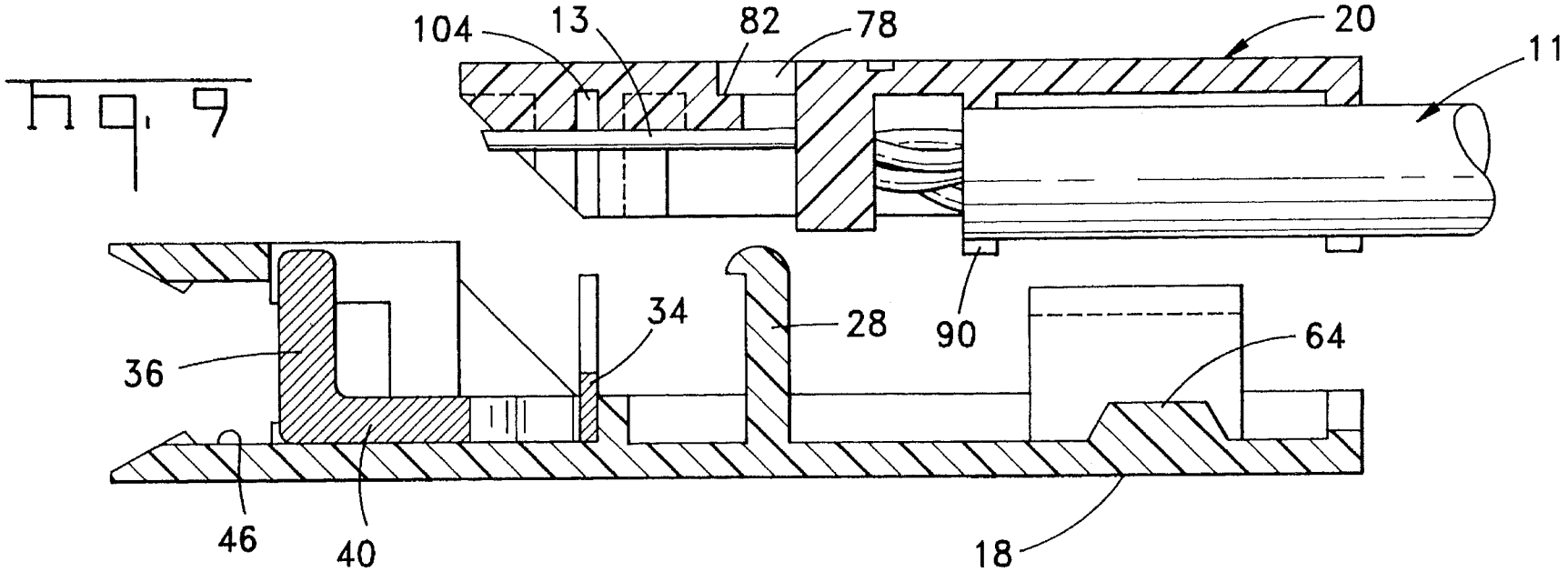
FIG. 9 is a longitudinal sectional view showing a wire loaded connector housing member just prior to wire termination and mating with a complementary housing member.
Figure 10:
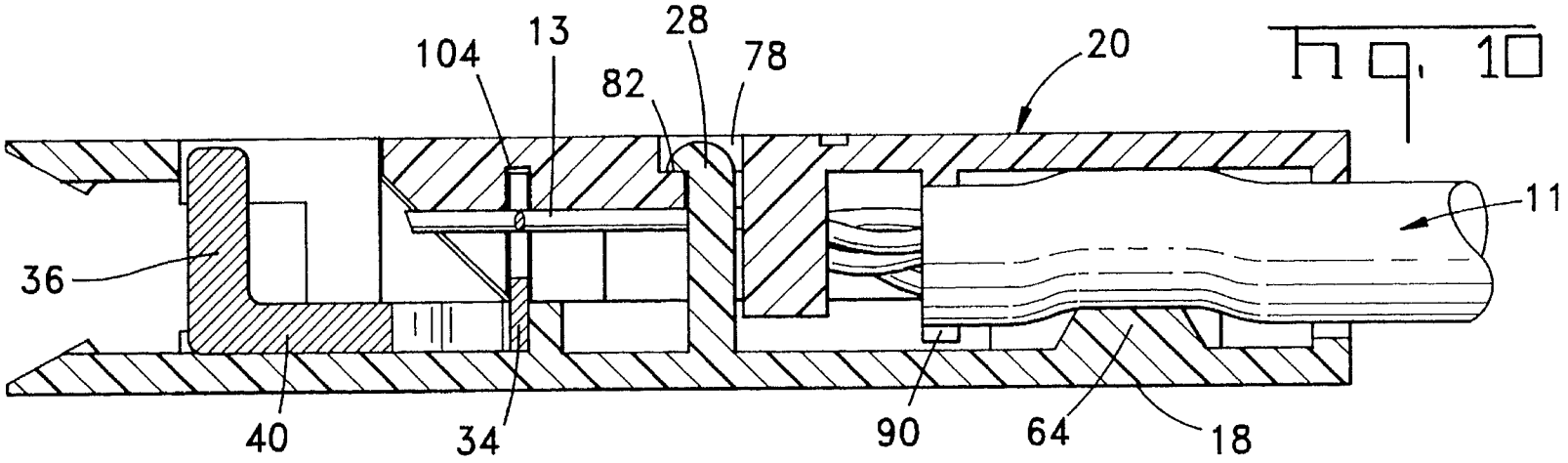
FIG. 10 is a longitudinal sectional view of a terminal/mated connector according to this invention.

To effect such termination and mating of the respective housing members 18, 20, reference may be made to FIGS. 9 and 10. Before discussing the termination and mating sequence, note in FIGS. 7 and 8 that a transverse slot 104 has been provided at each wire receiving slot 98. Such transverse slot, as will be seen in FIGS. 9 and 10, is intended to receive the insulation displacement end 34 of terminal 14 as the respective housing members 18, 20 are mated. Returning now to FIGS. 9 and 10, in the premating position of FIG. 9, second housing member 20 is poised above first housing member 18. The wires 13 have been trimmed with the wire ends supported on each side of slot 104, a practice typically followed for IDC termination. That is, the second housing member 20 acts as a stuffer member to effect the termination of the wire in the slotted beam of terminal end 34. Additionally, as the housing members are brought into a mating position the several posts 28, 30 enter their respective holes 78, 80, where they engage and latch to a respective shoulder 82, 84. With the connector 10 assembled, see FIGS. 3 and 10, the twist and length of each wire pair is controlled and selected pairs of twisted wires are maintained to achieve a high performance level for the patch cord cable assembly of this invention. Additionally, a strain relief is provided to the jacketed cable 11 (FIG. 10) by the application of pressure by projection 64, and the opposing pressure of the jacket stop 90.

We claim:

1. A patch cord cable assembly for use in a high speed transmission cable network, where the assembly is capable of transmitting data at 100 MHz frequency while offering near-end crosstalk (NEXT) at EIA/TIA 568-A Category 5 performance levels, said assembly comprising:

(a) a twisted pair cable including plural twisted pairs of wires, each pair having a different twist length, the twist for each pair being uniform over the length of the cable with the exception of portions of the cable adjacent the ends of the cable, (b) a cable jacket surrounding the plural twisted wire pairs, and (c) an electrical connector on each end of the cable assembly, where at least one of said connectors comprises a pair of interfitting housing members, a plurality of side-by-side electrical terminals positioned between said housing members for establishing electrical contact with the individual wires in the cable, said terminals being arranged at essentially one end of the housing members and the cable is caused to enter said housing members from an opposite end thereof, one of said housing members including a cable jacket stop intermediate said ends and plural, spaced-apart posts between said cable jacket stop and said one end, whereby said jacketed cable is fed into said one housing member and the end of said jacket seats in said cable jacket stop with each pair of twisted wires continuing toward said one end, guided by spaced-apart posts to control spacing, bend radius, and length of each pair, and the respective ends of individual wires are positioned for termination to respective electrical terminals.

2. The patch cord cable assembly according to claim 1, wherein the second of said housing members includes plural latching arms for latchedly engaging corresponding recesses in said one housing member.

3. The patch cord cable assembly according to claim 2, wherein said second housing member includes a strain relief member to engage said cable jacket during latching engagement of said housing members.

4. The patch cord cable assembly according to claim 2, wherein said electrical terminals include a split beam termination end to terminate said wires by an insulation displacement technique.

5. The patch cord cable assembly according to claim 4, wherein the opposite ends of said electrical terminals include a vertically oriented blade portion for mating with a complementary electrical connector having an array of split beam contacts.

6. The patch cord cable assembly according to claim 1, wherein the individual wires of a selected pair are maintained in a twisted state from said jacket stop to termination of said individual wires.

7. The patch cord cable assembly according to claim 1, wherein said one housing member includes an angular face, and said individual wires ends after termination are trimmed along said angular face.

8. The patch cord cable assembly according to claim 4, wherein said electrical terminals include a vertically arranged blade portion, said termination end, and a shank portion extending therebetween, where said shank portion is aligned with a slot in said split beam termination end.

9. The patch cord cable assembly according to claim 8, wherein there is an array of plural electrical terminals, and said shank portions of adjacent said terminals alternate from the top and bottom of said blade portion.

10. The patch cord cable assembly according to claim 1, wherein said assembly includes a strain relief acting against opposite sides of said cable jacketed wires.

* * * * *